US006162083A

United States Patent [19]

Seto

[11] Patent Number: 6,162,083

[45] Date of Patent: Dec. 19, 2000

[54] ELECTRICAL CONNECTOR SYSTEM FOR FLAT CIRCUITRY

[75] Inventor: Masashi Seto, Zama, Japan

[73] Assignee: Molex Incorporated, Lisle, Ill.

[21] Appl. No.: 09/143,694

[22] Filed: Aug. 28, 1998

[30] Foreign Application Priority Data

Aug. 29, 1997 [JP] Japan ..... 9-249954

[51] Int. Cl.[7] ..... H01R 13/62

[52] U.S. Cl. ..... 439/328

[58] Field of Search ..... 439/260, 328, 439/495, 358, 357

[56] References Cited

U.S. PATENT DOCUMENTS 3,149,896 9/1964 Hall .

5,660,557 8/1997 Lemke et al. ..... 439/328

*Primary Examiner*—Khiem Nguyen

*Attorney, Agent, or Firm*—Stephen Z. Weiss

[57] ABSTRACT

An electrical connector system includes an elongated dielectric connector housing defining an elongated opening for receiving a flat circuit. A plurality of terminals are mounted on the housing and have contact portions spaced along the opening. An actuator is mounted on the housing for movement between a first position allowing free insertion of the flat circuit into the opening and a second position wherein a pressure plate of the actuator biases the circuit against the contact portions of the terminals. The flat circuit includes at least one latch aperture. The connector housing includes at least one latch projection allowing free insertion of the flat circuit into the opening but engaging the latch aperture in the circuit to resist withdrawal of the circuit from the opening.

12 Claims, 3 Drawing Sheets

ELECTRICAL CONNECTOR SYSTEM FOR FLAT CIRCUITRY

FIELD OF THE INVENTION

This invention generally relates to the art of electrical connectors and, particularly, to a connector system for terminating flat circuitry such as flat flexible circuits.

BACKGROUND OF THE INVENTION

A flat flexible circuit conventionally includes an elongated flat flexible dielectric substrate having laterally spaced strips of conductors on one or both sides thereof. The conductors may be covered with a thin, flexible protective layer on one or both sides of the circuit. If protective layers are used, cutouts are formed therein to expose the underlying conductors at desired contact locations where the conductors are to engage the conductors of a complementary mating connecting device which may be a second flat flexible circuit, a printed circuit board or the terminals of a mating connector.

There are a wide variety of zero insertion force electrical connectors particularly adapted for terminating flat circuits, such as flexible flat circuits, flexible printed circuit boards and the like. These electrical connectors conventionally have a housing mounting a plurality of terminals in a generally parallel array spaced along an elongated opening or slot for receiving an end of the flat circuit. Typically, these connectors use actuators to push the flexible flat circuits, flexible printed circuit boards or the like against resilient contact portions of the terminals.

The actuators of these flat circuit connectors typically are movable between a first position allowing free insertion of the flat circuit into the elongated opening or slot in the housing, and a second position wherein a pressure plate of the actuator biases the cable against the contact portions of the terminals. For instance, the end of the flat circuit may be stripped of its insulation so that the pressure plate biases exposed conductors of the circuit against the contact portions of the terminal.

Major problems continue to plague such flat circuit connectors, particularly in the area of cost and reliability. There continuously are problems in holding the flat circuit in the connector. Any lateral deviation of the flat circuit from its intended position will cause misalignment between the conductors of the flat circuit and the terminals of the connector, resulting in improper or inadequate connections. In addition, when the circuit is subjected to undesirable pulling forces strong enough to overcome the biasing forces of the actuator, the flat circuit can be withdrawn from the connector. The present invention is directed to solving these various problems.

SUMMARY OF THE INVENTION

An object, therefore, of the invention is to provide a new and improved electrical connector system for flat circuitry.

In the exemplary embodiment of the invention, a dielectric connector housing defines an opening for receiving a flat circuit. A plurality of terminals are mounted on the housing and have contact portions spaced along the opening. An actuator is mounted on the housing for movement between a first position allowing insertion of the flat circuit into the opening and a second position biasing the circuit against the contact portions of the terminals. The flat circuit includes at least one latch aperture. The housing includes at least one latch projection. The actuator performs a dual function of biasing the circuit against the contact portions of the terminals and maintaining engagement of the latch projection of the housing in the latch aperture in the circuit.

Preferably, a pair of the latch apertures are provided adjacent opposite edges of the flat circuit. A corresponding pair of latch projections are provided adjacent opposite ends of the opening. The latch apertures can be notches in opposite edges of the circuit or through holes in the circuit.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
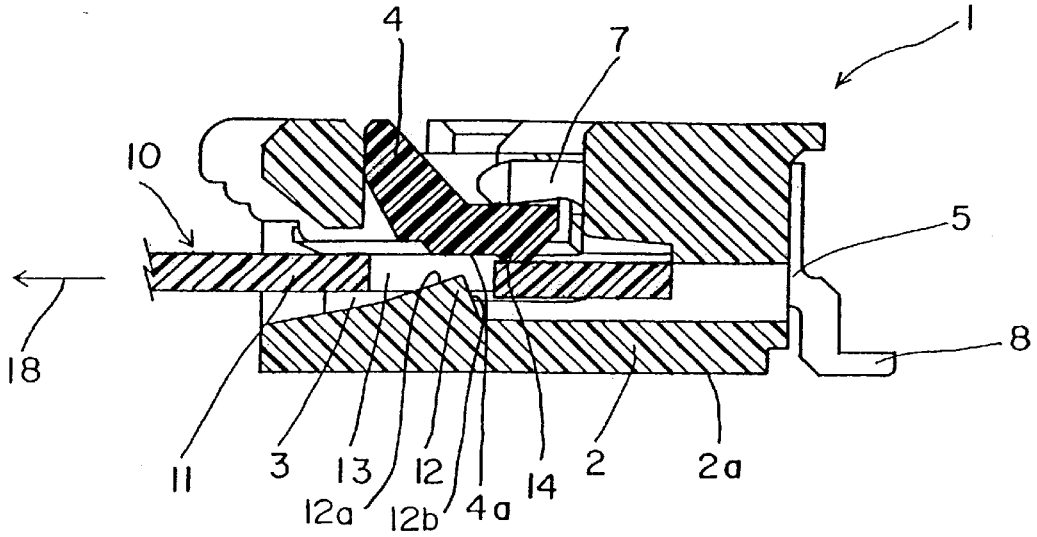
FIG. 1 is a vertical section, on an enlarged scale, taken generally along line A—A in FIG. 3.
Figure 2:
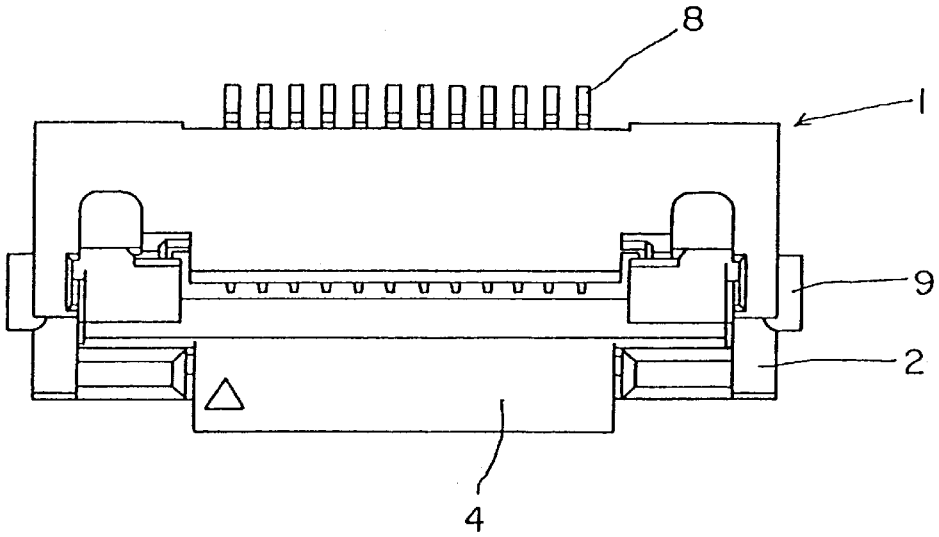
FIG. 2 is a top plan view of a flat circuit connector according to the invention.

Referring to the drawings in greater detail, the invention is embodied in an electrical connector, generally designated 1, which includes an insulating or dielectric housing 2 defining an elongated cable-insertion cavity or opening 3. An actuator 4 is pivotally mounted on the housing for movement between a first position shown in FIG. 6 allowing free insertion of a flat circuit 10 into the opening and a second position shown in FIGS. 1–5 wherein a pressure plate portion 4*a* of the actuator biases the circuit against contact portions of a plurality of terminals 5 mounted in the housing.

Specifically, terminals 5 are mounted in a parallel array longitudinally of opening 3. Each terminal includes a contact arm 6 having a contact portion 6*a* at a distal end thereof. Each terminal includes a fixing leg 7 for fixing the terminal in a respective one of a plurality of terminal-receiving passages 7*a* (FIG. 5) in the housing. The terminals are fixed so that contact legs 6 project forwardly of the housing to locate contact portions 6*a* of the terminals in the bottom of elongated opening 3 as clearly shown in FIG. 5. Finally, each terminal includes a tail portion 8 projecting rearwardly of the housing. The bottom surfaces of the tail portions are coplanar with the bottom surface 2*a* of housing 2 so that the housing can be surface mounted on a printed circuit board, while tail portions 8 of the terminals are soldered to appropriate circuit traces on the board.

Figure 3:
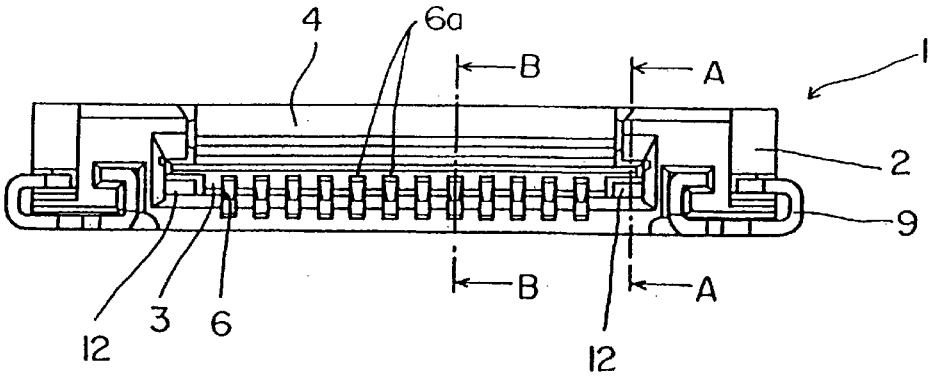
FIG. 3 is a front elevational view of the connector.
Figure 4:
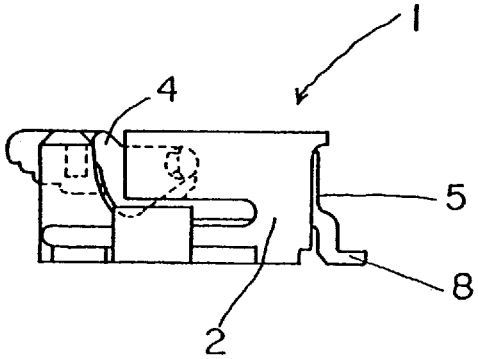
FIG. 4 is side elevational view of the connector.
Figure 5:
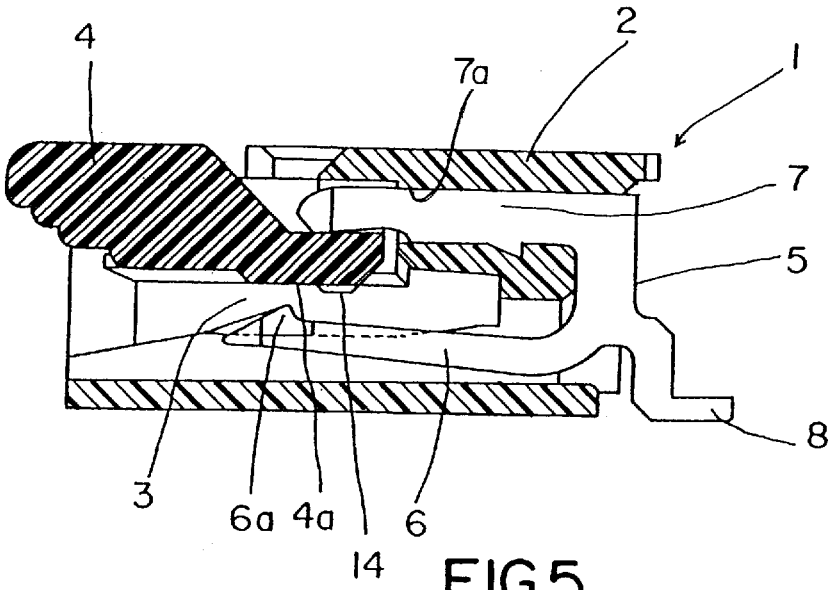
FIG. 5 is a vertical section, on an enlarged scale, taken generally along line B—B in FIG. 3.

As best seen in FIG. 1, housing 2 includes a latch projection 12 projecting upwardly into cable-insertion cavity or opening 3. As best seen in FIG. 3, one of the latch projections 12 is provided at each opposite end of the opening. Each latch projection has a gradually inclined front surface 12*a* (FIG. 1) which allows for free movement of the flat circuit thereover when the circuit is inserted into opening 3. Each latch projection 12 has an abrupt rear surface 12*b* which engages a latch aperture in the circuit (as described hereinafter) to resist withdrawal of the circuit from opening 3 in the housing.

Figure 7:
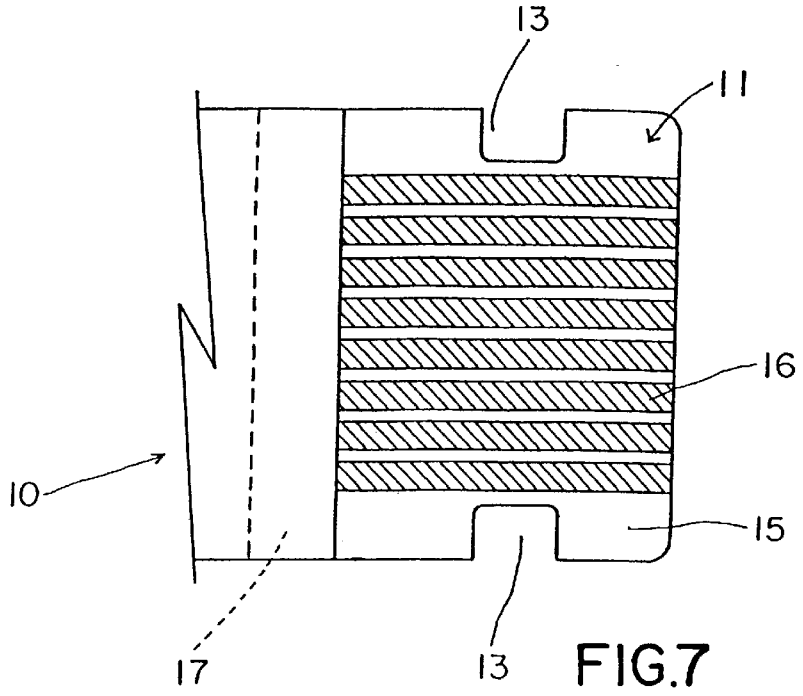
FIG. 7 is a bottom plan view of an end of a flat circuit according to the invention.
Figure 8:
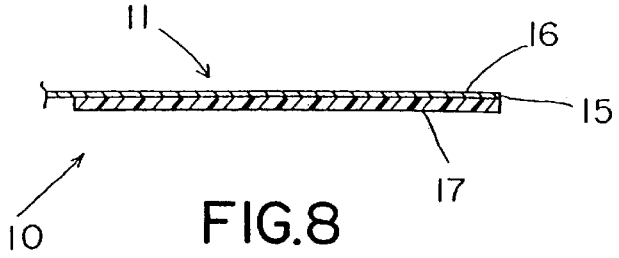
FIG. 8 is a longitudinal section of the circuit end.

Referring to FIGS. 7 and 8, flat circuit 10 includes a circuit end 11 with a pair of latch apertures in the form of notches 13 in opposite edges of the circuit. The circuit includes a flexible strip 15 having generally parallel conductors 16 on one side thereof and a reinforcing sheet 17 on the opposite side thereof. The circuit has a width generally equal to opening 3 in the housing, and conductors 16 are arranged at lateral intervals corresponding to the spacing or pitch between contact portions 6*a* of terminals 5. When the circuit is inserted into the housing, conductors 16 face downwardly for engagement with contact portions 6*a* of the terminals.

Figure 6:
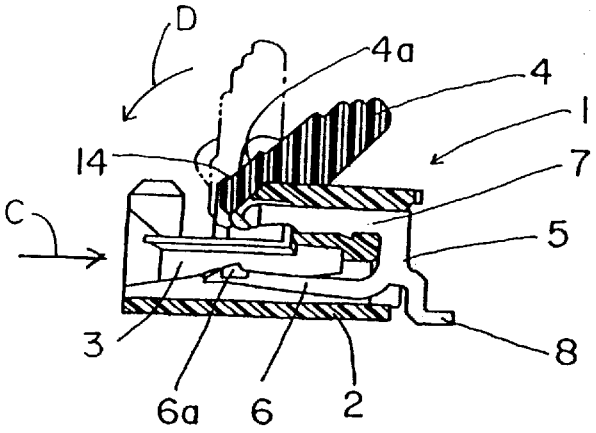
FIG. 6 is a section similar to that of FIG. 5, but with the actuator raised.

In operation, actuator 4 is rotated upwardly to its first position shown in FIG. 6. This allows flat circuit 10 to be inserted into elongated opening 3 in the direction of arrow "C". When inserted, conductors 16 of the circuit are aligned with contact portions 6*a* of terminal 5. In addition, latch apertures 13 in the circuit are aligned with latch projections 12 of the connector housing. During insertion of the circuit, the distal end of the circuit freely rides over the gradually inclined surfaces 12*a* of latch projections 12. However, abrupt rear surfaces 12*b* of the latch projections resist withdrawal of the circuit from the housing.

When the flat circuit is fully inserted into opening 3 in connector housing 2, actuator 4 is rotated downwardly in the direction of arrow "D" (FIG. 6) to its second position shown in FIGS. 1–5. In its second position, pressure plate 4*a* of the actuator performs a dual function of (a) biasing flat circuit 10 (i.e. conductors 16) against contact portions 6*a* of contact arms 6 of the terminals, and (b) biases the circuit into latching engagement with latch projections 12 of the housing projecting into latch apertures 13 of the circuit. The circuit now cannot be withdrawn from the connector in the direction of arrow 18 (FIG. 1).

Figure 9:
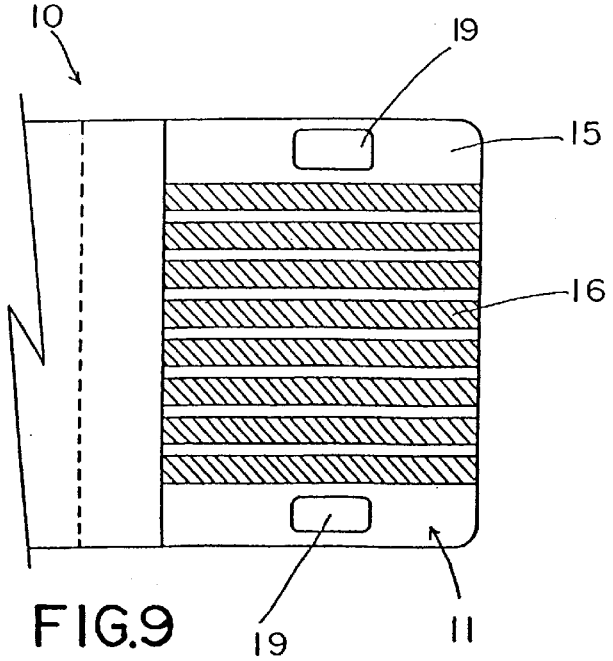
FIG. 9 is a plan view similar to that of FIG. 7, but of an alternate embodiment of the circuit.

Lastly, FIG. 9 shows an alternate embodiment of flat circuit 10. In this embodiment, latch apertures are provided in the form of through holes 19 adjacent opposite edges of the circuit. These through holes function similar to the latch apertures provided by notches 13 in the embodiment of FIG. 7 and described above.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector system for terminating a flat circuit, comprising:

an elongated dielectric connector housing defining an elongated opening for receiving a flat circuit, with a plurality of terminals mounted on the housing and having contact portions spaced along the opening;

an actuator mounted on the housing for movement between a first position allowing free insertion of the flat circuit into the opening and a second position wherein a pressure plate of the actuator biases the circuit against the contact portions of the terminals;

said flat circuit including at least one latch aperture;

said connector housing including at least one latch projection allowing free insertion of the flat circuit into the opening but engaging the latch aperture in the circuit to resist withdrawal of the circuit from the opening; and the latch projection having a gradually inclined front surface to allow free movement of the flat circuit thereover upon insertion of the circuit into the opening and an abrupt rear surface engageable in the latch aperture to resist withdrawal of the circuit from the opening.

2. The electrical connector system of claim 1 wherein said actuator is at one side of the opening in the connector housing and said latch projection is at an opposite side of the opening, whereby the actuator is effective in its second position to latch the flat circuit to the housing.

3. The electrical connector system of claim 1, including a pair of said latch apertures adjacent opposite edges of the flat circuit and a corresponding pair of said latch projections adjacent opposite ends of said opening.

4. The electrical connector system of claim 1 wherein said latch aperture comprises a through hole in the flat circuit.

5. The electrical connector system of claim 1 wherein said latch aperture comprises a notch in an edge of the flat circuit.

6. An electrical connector system for terminating a flat circuit, comprising:

an elongated dielectric connector housing defining an elongated opening for receiving a flat circuit, with a plurality of terminals mounted on the housing and having contact portions spaced along the opening;

an actuator mounted on the housing at one side of said elongated opening for movement between a first position allowing free insertion of the flat circuit into the opening and a second position wherein a pressure plate of the actuator biases the circuit against the contact portions of the terminals;

said flat circuit including a pair of latch apertures adjacent opposite edges thereof; and said connector housing including a pair of latch projections at opposite ends of said opening and at a side of the opening opposite the actuator, the latch projections having gradually inclined front surfaces to allow free movement of the flat circuit thereover upon insertion of the circuit into the opening and abrupt rear surfaces engageable in the latch apertures to resist withdrawal of the circuit from the opening.

7. The electrical connector system of claim 6 wherein said latch apertures comprise through holes in the flat circuit.

8. The electrical connector system of claim 6 wherein said latch apertures comprise notches in opposite edges of the flat circuit.

9. An electrical connector system for terminating a flat circuit, comprising:

a dielectric connector housing defining an opening for receiving a flat circuit, with a plurality of terminals mounted on the housing and having contact portions spaced along the opening;

an actuator mounted on the housing for movement between a first position allowing insertion of the flat circuit into the opening and a second position biasing the circuit against the contact portions of the terminals;

said flat circuit including at least one latch aperture; and said connector housing including at least one latch projection on a side of the opening opposite the actuator, the latch projection having a gradually inclined front surface to allow free movement of the flat circuit thereover upon insertion of the circuit into the opening and an abrupt rear surface engageable in the latch aperture to resist withdrawal of the circuit from the opening, whereby the actuator performs a dual function of biasing the circuit against the contact portions of the terminals and maintaining engagement of the latch projection of the housing in the latch aperture of the flat circuit.

10. The electrical connector system of claim 9, including a pair of said latch apertures adjacent opposite edges of the flat circuit and a corresponding pair of said latch projections adjacent opposite ends of said opening.

11. The electrical connector system of claim 9 wherein said latch aperture comprises a through hole in the flat circuit.

12. The electrical connector system of claim 9 wherein said latch aperture comprises a notch in an edge of the flat circuit.

* * * * *